US006578305B2

(12) United States Patent
Lebrun

(10) Patent No.: US 6,578,305 B2
(45) Date of Patent: Jun. 17, 2003

(54) FRAMING SYSTEM WITH THREE DIMENSIONAL SHIMS FOR DISPLAYING THREE-DIMENSIONAL OBJECTS

(76) Inventor: Steven C. Lebrun, 2402 NW. 40th Cir., Boca Raton, FL (US) 33431

( * ) Notice: Subject to any disclaimer, the term of this patent is extended or adjusted under 35 U.S.C. 154(b) by 83 days.

(21) Appl. No.: 09/780,972

(22) Filed: Feb. 10, 2001

(65) Prior Publication Data

US 2001/0045043 A1 Nov. 29, 2001

Related U.S. Application Data

(60) Provisional application No. 60/185,600, filed on Feb. 28, 2000.

(51) Int. Cl.[7] ..... A47G 1/06

(52) U.S. Cl. ..... 40/800; 40/739; 40/770; 40/794

(58) Field of Search ..... 40/739, 740, 741, 40/794, 800, 770, 777, 768; 312/245

(56) References Cited

U.S. PATENT DOCUMENTS

| | | | | | |
|---|---|---|---|---|---|
| 132,314 | A | * | 10/1872 | Moulton | 40/770 X |
| 1,882,157 | A | * | 10/1932 | Minton | 40/770 X |
| 2,092,348 | A | * | 9/1937 | Cross | 40/770 X |
| 2,288,732 | A | * | 7/1942 | Nickerson | 40/800 X |
| 3,023,525 | A | * | 3/1962 | Cointreau | 40/739 |
| 3,521,936 | A | * | 7/1970 | Coker, Jr. | 312/245 |
| 3,996,682 | A | * | 12/1976 | Schwartz | 40/794 |
| 4,353,327 | A | * | 10/1982 | Shroyer | 40/800 X |
| 5,524,980 | A | * | 6/1996 | Carter et al. | 312/245 X |
| 5,806,223 | A | * | 9/1998 | Visagie | 40/800 |
| 6,119,386 | A | * | 9/2000 | Henry et al. | 40/768 X |

* cited by examiner

*Primary Examiner*—Joanne Silbermann
(74) *Attorney, Agent, or Firm*—John C. Smith

(57) ABSTRACT

An adjustable framing system for three-dimensional objects which has a three-dimensional shimming system and an access door in the rear. The access door allows objects to be easily inserted, and then temporarily removed for examination, and subsequently easily replaced. The framing system has a deep compartment for holding publications having a variety of sizes. The framing system is designed to accommodate varying sized publications by using matting in the front of the event programs, and a three-dimensional shimming system which includes vertical and horizontal shimming on the sides of the event program, and thickness shimming on the rear of the event program. An internal wall provides depth for an internal cavity which provides room for publications or other objects that vary in thickness. Separate display compartments may be provided for displaying tickets or descriptive labels for the objects in the frame.

12 Claims, 10 Drawing Sheets

FRAMING SYSTEM WITH THREE DIMENSIONAL SHIMS FOR DISPLAYING THREE-DIMENSIONAL OBJECTS

CROSS-REFERENCE TO RELATED APPLICATIONS

This application is related to the commonly owned copending application entitled "Frame with Three Dimensional Shimming System for Displaying Three-dimensional Objects", filed Feb. 28, 2000, bearing U.S. Ser. No. 60/185,600 and naming Steven C. Lebrun, the named inventor herein, as sole inventor, the contents of which is specifically incorporated by reference herein in its entirety.

BACKGROUND OF THE INVENTION

1. Technical Field

The present invention relates to picture frames. In particular, it relates to a picture framing system with an interior storage compartment for displaying one or more three-dimensional objects. The three dimensional objects may be one of many types of objects. For example, souvenirs, awards, sports paraphernalia, publications, etc. As used herein, the term "publication" will be used to describe many types of printed matter, including theater programs, sports programs, graduation commencement programs, etc., and for the simultaneous storage of associated items such as admission tickets and other souvenirs, etc. The framing system is designed to allow an unskilled "do-it-yourselfer" to install and arrange one or more three dimensional objects within the frame, and to allow interior access via a rear access door for the temporary removal, examination, and re-installation of objects in the frame.

2. Background Art

Every individual attends a special event at one time or another. Most people enjoy keeping souvenir items, publications such as sporting event programs, theater programs (e.g. Playbill (TM)), graduation programs, along with associated admission tickets, etc. to remember the particular event, which may often be a once in a lifetime event. Unfortunately, when these items are not stored properly, they become dog-eared, frayed, or damaged, which results in a tangible remembrance of the experience being lost.

Likewise, an individual may want to keep several souvenir items related to a special event. For example, if an athlete enters a marathon race, there is typically a program distributed to the runners that describes the event. In addition, runners may also wish to display a the number they wore, their admission ticket, any medals they may have won, or any special items they may have carried with them. As a result, in addition to a relatively flat item such as a program, an individual may want to include other three-dimensional items that are related to the event described by the program. It would be desirable to have a convenient method of framing one or more three-dimensional objects which could be easily removed from the frame by the individual when desired.

The foregoing example, which was related to runners, can be applied to almost any athletic event. For example, it is not uncommon for an individual who goes to a hockey game to obtain not only a program, but also to obtain souvenirs related to a particular team or related to a special game, such as a championship game (e.g. the rubber rats distributed at Florida Panthers NHL hockey games). In addition, it is not uncommon for individuals at hockey games to acquire a hockey puck. Hockey fans are similar to runners, as discussed above, in that hockey fans may often wish to store and display all of the items they acquire at a particular event within a single storage and display unit.

In addition to the athletic activities described above, other events, such as school graduations, weddings, etc. often result in an individual having many nostalgic items that the individual would like to store and display in a single storage device. It would be desirable for individuals having two dimensional, and/or three dimensional objects to be able to store and display those objects within a single container.

One method of preventing this type of damage is to frame the entire publication. However, if the individual decides to protect the publication using a conventional picture frame, the publication may actually have to be damaged in order to fit, since frames typically do not have the depth to store the entire publication. Therefore, usually only the cover page is framed and the remainder of the publication is typically discarded.

Framing these items has always been possible using professional or custom framing services who permanently seal the items within the frame. Unfortunately, conventional methods of displaying nostalgic items typically result in their being permanently encased within a display frame such that they would be damaged upon removal. It would be desirable for the owner of nostalgic items to be able to easily remove and replace items in the display frame from time to time without damaging them. However, custom framers generally want to frame only covers because it is difficult to frame an entire publication without a specially designed cavity which is specifically made to fit that particular item. Likewise, other three dimensional items would require a custom frame maker to construct a cavity with a structure specifically designed to hold that particular item. The drawback associated with storing these items in this type of frame is that a custom-made frame tends to be expensive. Also, since a custom frame would typically be sealed, it would not allow access to the items inside, and as a result, the owner could not removal items for examination. It would be desirable to have an inexpensively produced framing system that would allow an unskilled individual to store three dimensional items within a frame, and would also allow access for an individual to occasionally remove and replace one or more of the items from the framing system.

Conventional frames typically have a rear panel which is secured to the side walls of the frame. This type of structure does not lend itself to easy removal of items within the frame. It would be desirable to have a frame structure which provided an easy and convenient method of accessing the interior of the frame.

Another disadvantage associated with prior art frame and/or display systems is that they are designed to use a set of standard sizes, such has 8×10 inches, etc. Unfortunately, nostalgic items are unpredictable in size and may often be very unlikely to fit within a standard size frame. In addition, nostalgic items are typically three dimensional in nature and cannot fit within a conventional frame. It would be desirable to have a frame with sufficient size to accommodate nostalgic items and which also has the flexibility to adjust the placement of nostalgic items within the frame so that they are properly displayed.

While addressing the basic desirability of protecting nostalgic items such as event programs, the prior art has failed to provide a frame for preserving and protecting event programs and/or nostalgic items which would allow those event programs and/or nostalgic items to be stored intact, and which would further allow the event programs and/or nostalgic items to be taken out and examined and then easily placed back in the protective frame. Further, the prior art has failed to provide a storage and display system which is capable of simultaneously storing and displaying multiple two and three-dimensional items.

SUMMARY OF THE INVENTION

The present invention solves the foregoing problems by providing a framing system for three-dimensional objects which has an integral compartment for holding two and three dimensional objects, a three-dimensional shimming system for properly positioning those objects, and an access door in the rear to provide easy insertion and removal of the objects from time to time. The access door allows objects to be easily inserted, and then temporarily removed for examination, and subsequently easily replaced. The framing system has a deep compartment for holding publications and/or nostalgic items having a variety of sizes. The framing system is designed to accommodate varying sized publications by using matting in the front of the event programs, and a three-dimensional shimming system which includes vertical and horizontal shimming on the sides of the event program, and thickness shimming on the rear of the event program. An internal perimeter wall provides depth for, and defines, the internal cavity which provides room for event programs and nostalgic items that vary in thickness.

DESCRIPTION OF THE PREFERRED EMBODIMENT

Figure 1:
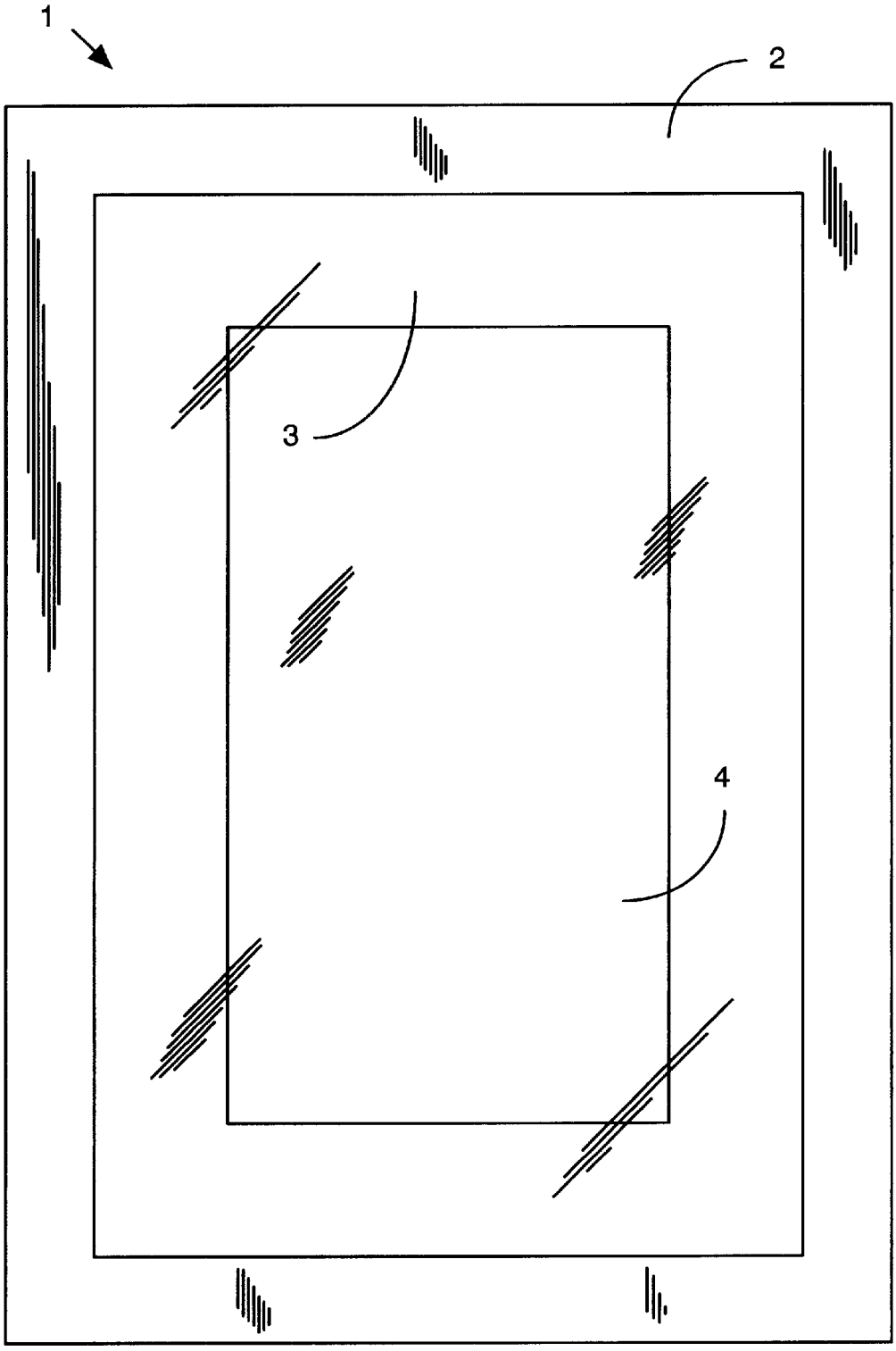
FIG. 1 is a front view of the preferred embodiment of the invention which shows the frame, the front panel, and the underlying matting.

FIG. 1 is a front view of the preferred embodiment of the frame 1. The frame 1 has a peripheral border 2. The peripheral border 2 can be constructed from any suitable material, including wood, metal, glass, plastic, stone, etc. The front panel 4 is secured within the peripheral border 2. Those skilled in the art will realize that any suitable transparent material, such as glass, plastic, Lucite (tm), Lexan (tm), acrylic, etc., can be used to fabricate front panel 4. The only requirement is that the front panel 4 be transparent so that the items inside the frame 1 can be seen. Also shown in this figure is a section of matting 3 that is placed under the front panel 4. As seen from this view, the frame 1 gives the outward appearance of an ordinary picture frame.

Figure 2:
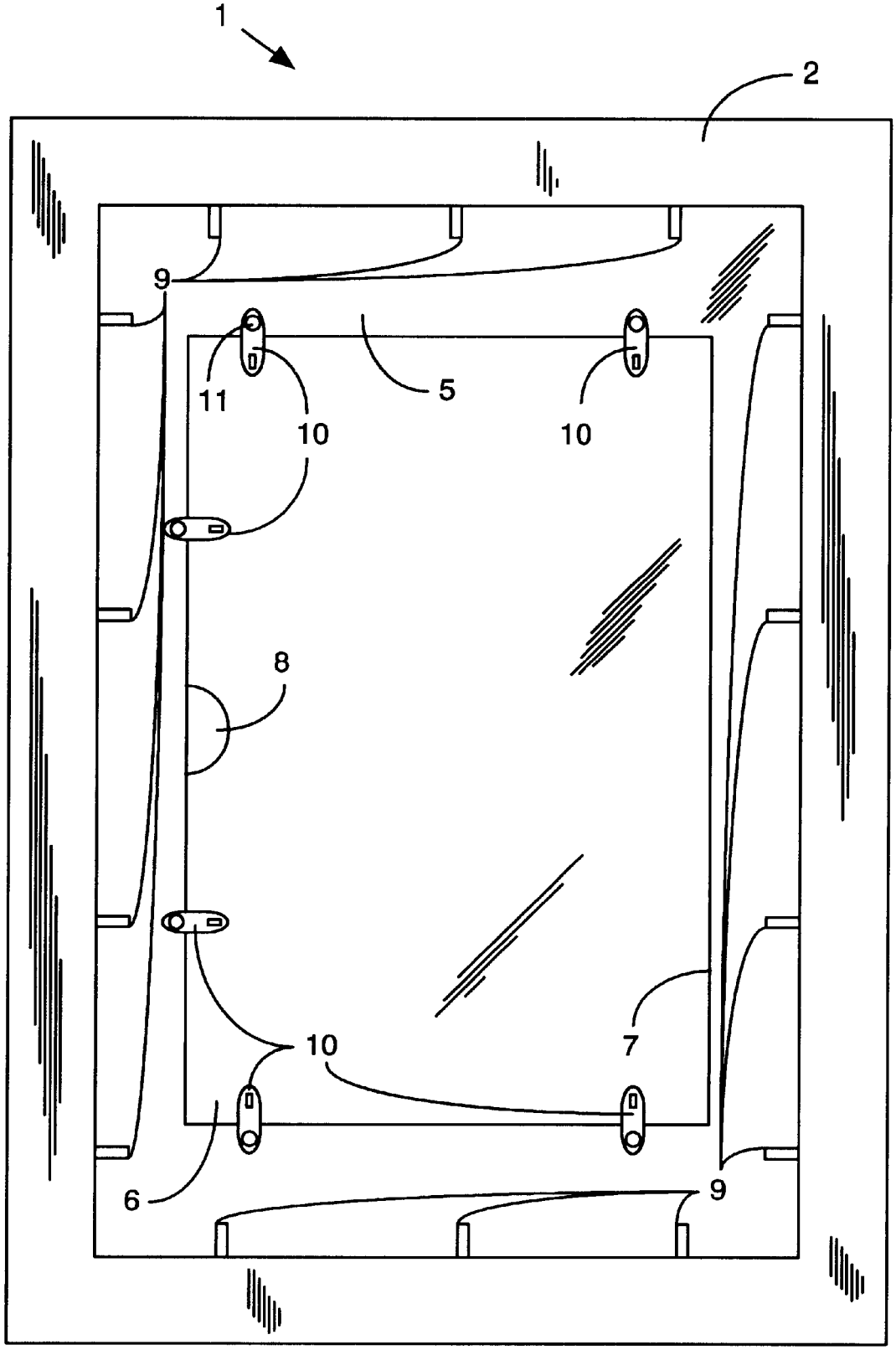
FIG. 2 is a rear view of the preferred embodiment of FIG. 1 which shows the frame, the rear panel, and the access door. This figure illustrates the access door in the closed position.

FIG. 2 is a rear view of a preferred embodiment of the frame 1. In this figure, a rear panel 5 is secured to the peripheral border 2 with retaining pins 9. The retaining pins 9 are used in the same manner as they would be used in a conventional picture frame. Those skilled in the art will recognize that while retaining pins are shown securing the rear panel 5 to the peripheral border 2, any suitable means can be used to secure the rear panel 5 to the peripheral border 2. For example, the retaining pins 9 can be eliminated entirely, and a simple slot in the peripheral border 2 can be formed to accept the rear panel 5 as is done in many conventional picture frames.

Also shown in this figure is access door 6 which is attached to rear panel 5 at hinge 7. Hinge 7 may be implemented by any suitable hinge structure. However, in the preferred embodiment a living hinge is used. Locking tabs 10, which rotate on pivot pins 11, are used to secure access door 6 in the closed position. Aperture 8 is used to open the access door 6 when locking tabs 10 are rotated out of the way. In this figure, aperture 8 is illustrated as an opening suitable for a user to place a fingertip through to open the access door 6.

Those skilled in the art will realize that aperture 8 can be replaced with a pull tab, a string, or any other suitable device for opening the access door 6. Likewise, hinge 7 can be eliminated, and the access door 6 can be attached to the rear panel 5 solely by locking tabs 10. This can be done, for example, by having an overlap on the access door 6 such that it rests against the rear panel 5 and is held in place by the locking tabs 10.

This figure is shown with the access door 6 in the closed position. In the closed position, the locking tabs 10 are rotated over the edge of the access door 6 to secure the access door 6 in place. Of course, a variety of securing mechanisms can be used in place of the locking tabs 10. For example, sliding ends, hook and loop strips, etc can be used in place of the locking tabs 10. The only requirement is that the access door 6 can be secured in place when in the closed position, can be easily opened when desired, and is strong enough to hold the displayed item in place.

Figure 3:
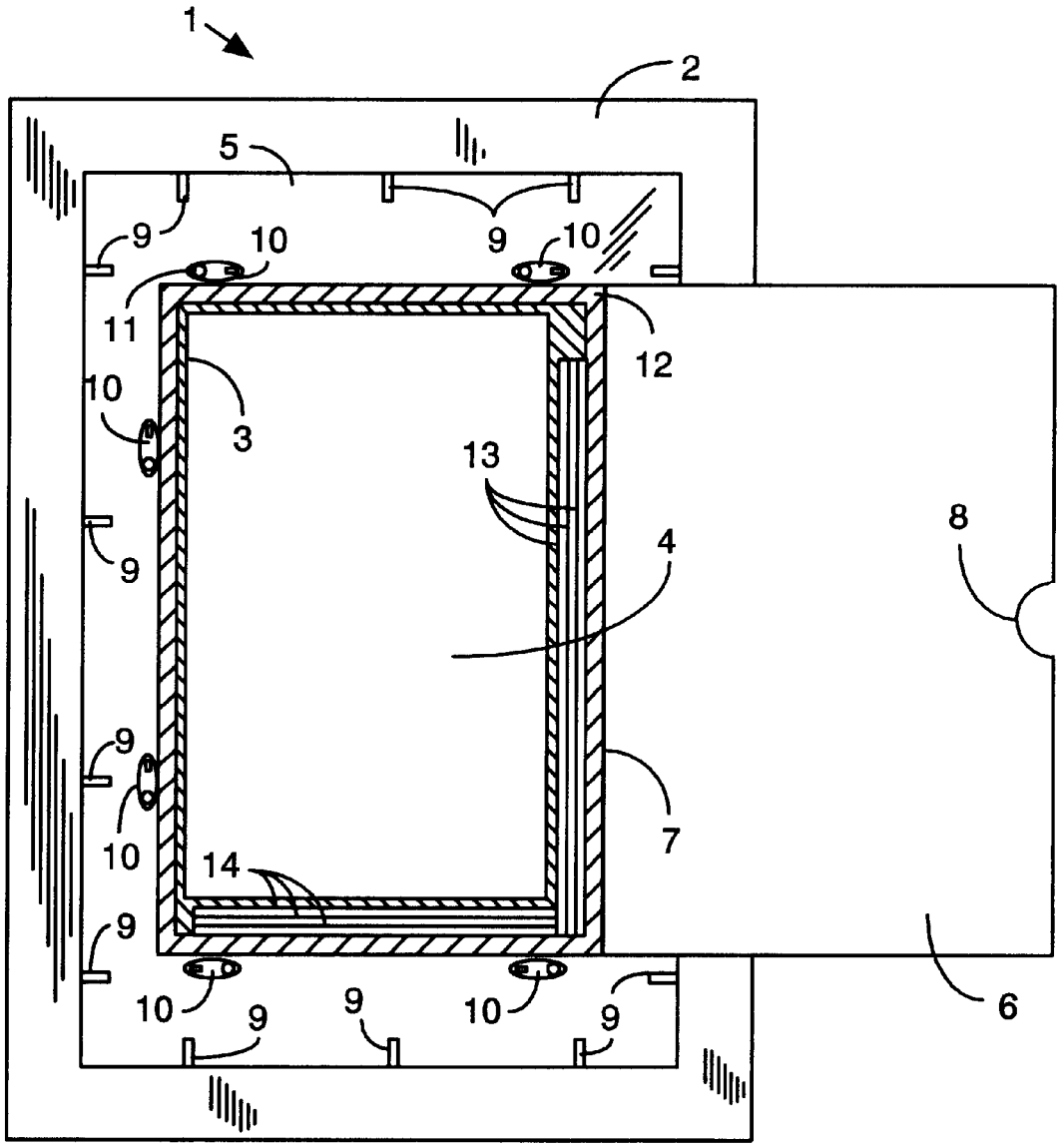
FIG. 3 is a rear view of the preferred embodiment of FIG. 1 which shows the access door in the open position.

FIG. 3 illustrates the embodiment of FIG. 2 with the access door 6 in the open position. With the access door 6 in the open position, the interior wall 12 is visible. The interior wall 12 is designed to provide depth, by separating the front panel 4 from rear panel 5. The size of the internal cavity available for use by event programs is determined by the thickness of the interior wall 12. The thickness of the interior wall 12 can vary based on the intended object which it is designed to hold. For example, the thickness can be set such that it accommodates a publication such as a magazine, an event program, etc. It can also have a thickness which is selected to allow storage and display of thicker three-dimensional objects in combination with a magazine, event program, etc. Those skilled in the art will realize that the interior wall 12 can be implemented not only as a contiguous wall, but also as several posts of any convenient shape which provide the function of separating the front panel 4 from the rear panel 5. That is used herein, the term "interior wall 12" can be applied to both continuous wall structures and noncontiguous posts or structures used to separate the front panel 4 from the rear panel 5.

Matting 3 is shown underneath interior wall 12 in this figure. Matting 3 would typically be a conventional matting used with any picture frame, and fabricated from any suitable material.

Vertical shimming 14 and horizontal shimming 13 are also shown. By varying the thickness of the vertical shimming 14 and the horizontal shimming 13, the position of the event program can be adjusted by selecting the appropriate amount of shims. The shims 13, 14, in combination with the matting 3, allow publications or other three dimensional objects to be inserted and properly displayed by a single frame 1.

The locking tabs 10 are shown rotated away from the access door 6 in this figure, such that the access door 6 can be opened or closed without interference from the locking tabs 10.

Figure 4:
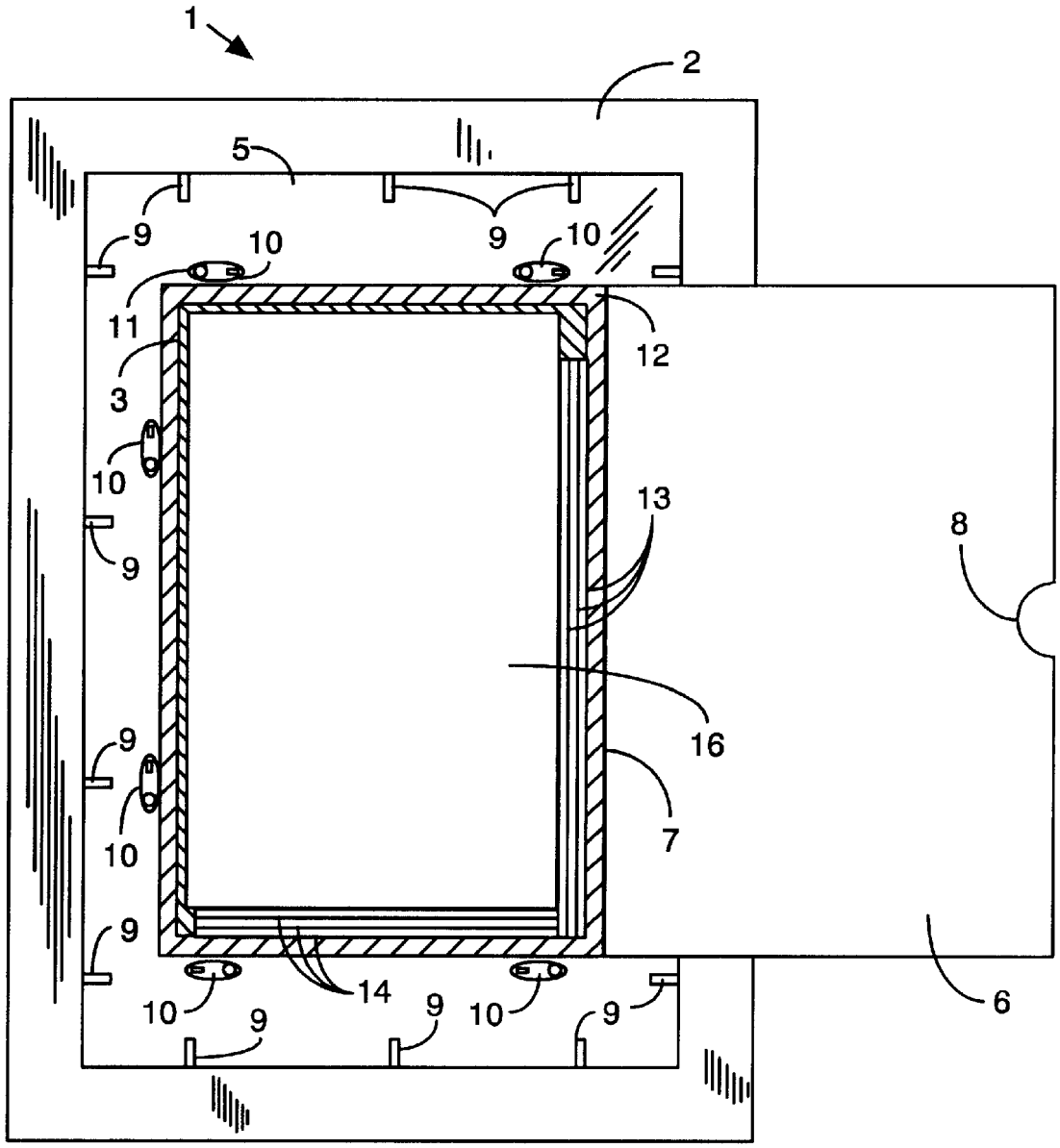
FIG. 4 is a rear view of the preferred embodiment of FIG. 1 which illustrates an event program inserted into the frame through the access door, and positioned by vertical and horizontal shimming.

FIG. 4 illustrates a rear view of the frame 1 with the access door 6 in the open position. In this figure, an event program 16 is shown mounted in the frame 1. In this figure, the event program 16 rests on top of the vertical shims 14 and next to the horizontal shims 13 to secure the event program in the proper position. As noted above, the amount of vertical shims 14 and horizontal shims 13 can be adjusted to accommodate event programs of varying sizes. As a result, the same frame 1 can be used to accommodate publications or event programs 16 of varying sizes.

Figure 5:
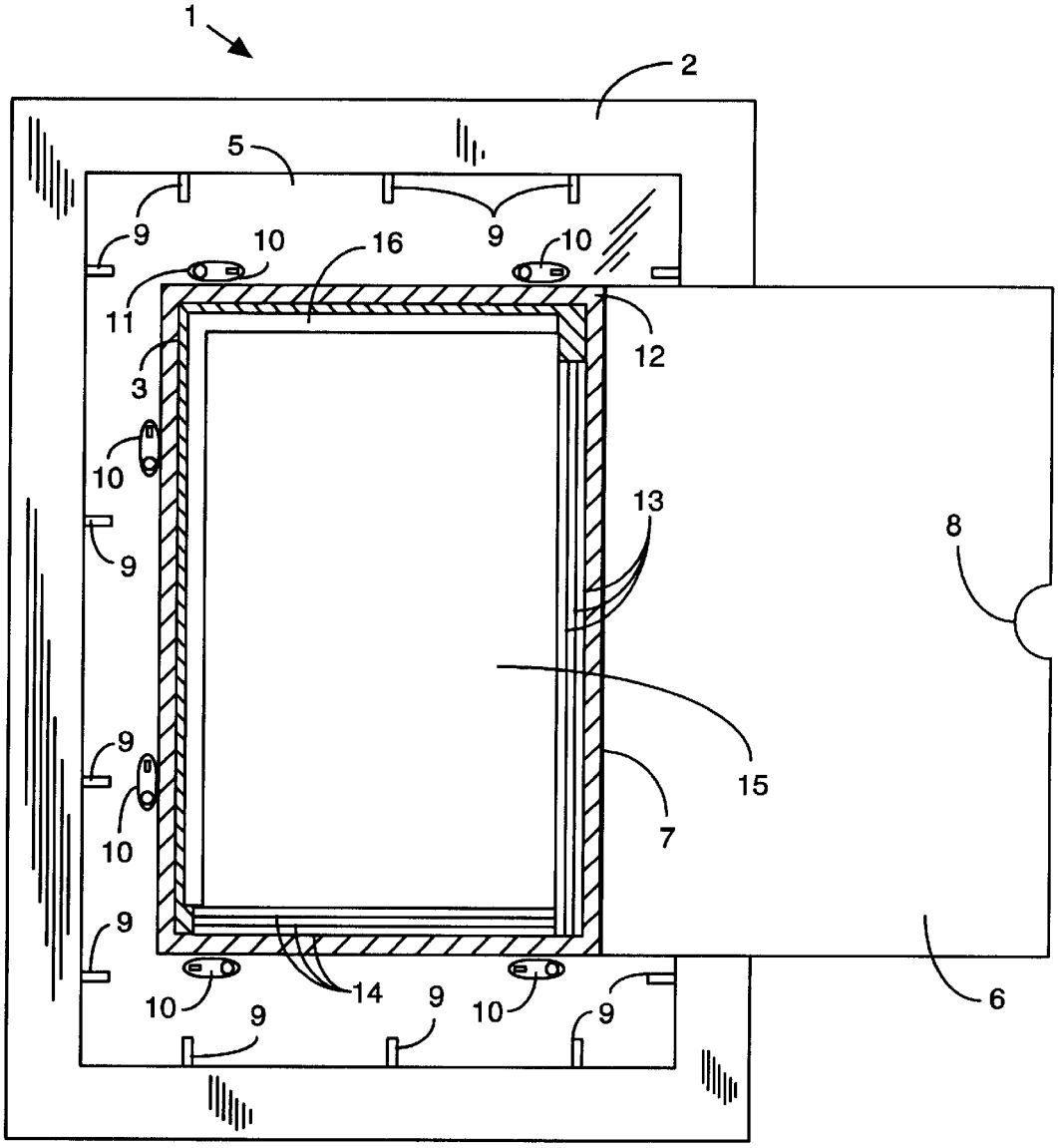
FIG. 5 is a rear view of the preferred embodiment of FIG. 1 which illustrates the placement of thickness shimming on the back of an event program previously inserted into the frame through the access door.

FIG. 5 illustrates a rear view of the frame 1 with the access door 6 in the open position. In this figure, an event program 16 is secured against the front panel 4 (shown in FIG. 1) by a thickness shim 15. When the access door 6 is closed, the thickness shim 15 is securely held in place against the event program 16. As can be seen from this figure, the vertical shims 14, the horizontal shims 13, and the thickness shims 15, can be used to secure the event program 16 in position in all three dimensions. As a result, the event program 16 will be held securely against front panel 4 so that it is properly displayed, regardless of its thickness.

In the event that the displayed item completely fills the area defined by the matting 3, the appearance of the thickness shim 15 is not important. However, in the event that the item displayed in the frame 1 does not completely fill the area defined by the matting 3, or if the matting 3 is omitted from the frame 1, then the surface of the thickness shim 15 should be properly finished such that it is suitable for viewing along with the object stored within the frame 1.

Figure 6A:
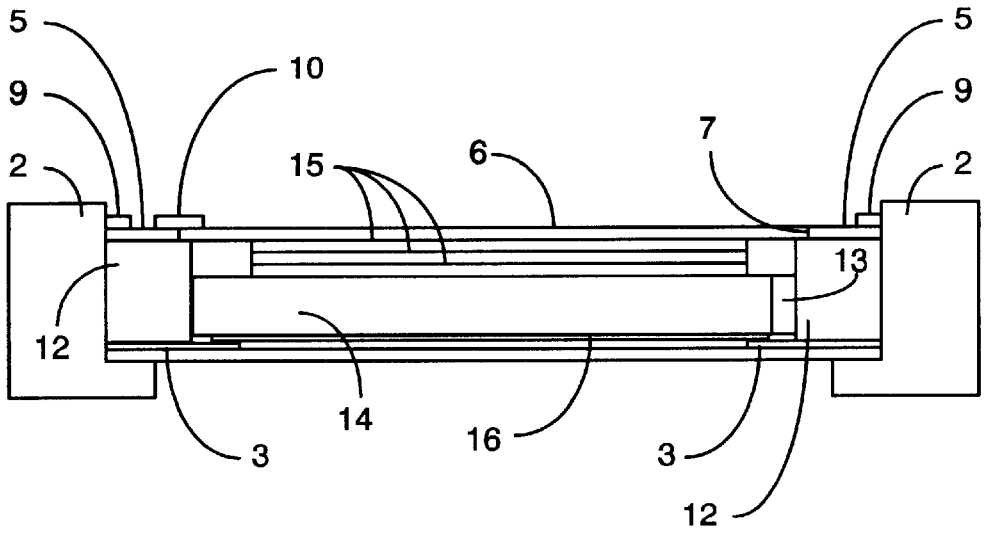
FIG. 6A is a bottom cut away view of the preferred embodiment of FIG. 1. This figure illustrates the vertical shimming, the horizontal shimming, and thickness shimming used to position an event program. This figure also illustrates the interior wall used to form the internal cavity.

In FIG. 6A, a bottom cut away view of frame 1 is shown. This view shows the position of the vertical shimming 14 under the event program 16. It also shows the thickness shims 15 pressing against the event program 16 and held in place by the access door 6. This figure also illustrates interior wall 12. As can be seen from this figure, by selecting the thickness of interior wall 12 the amount of available space (the internal cavity) to accommodate an event program 16 can be varied.

Figure 6B:
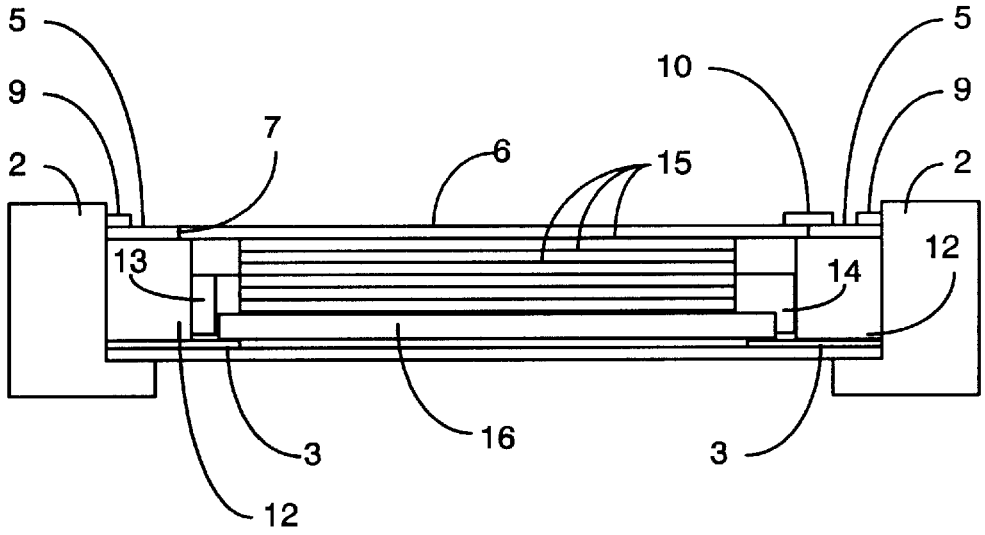
FIG. 6B is a top cut away view of the preferred embodiment of FIG. 1. This figure illustrates the horizontal shimming, the thickness shimming, and the interior wall used to form the internal cavity.

In FIG. 6B, a top cut away view of frame 1 is shown. This figure illustrates the thickness shims 15 securing the event program 16 in place inside the frame 1.

Figure 7:
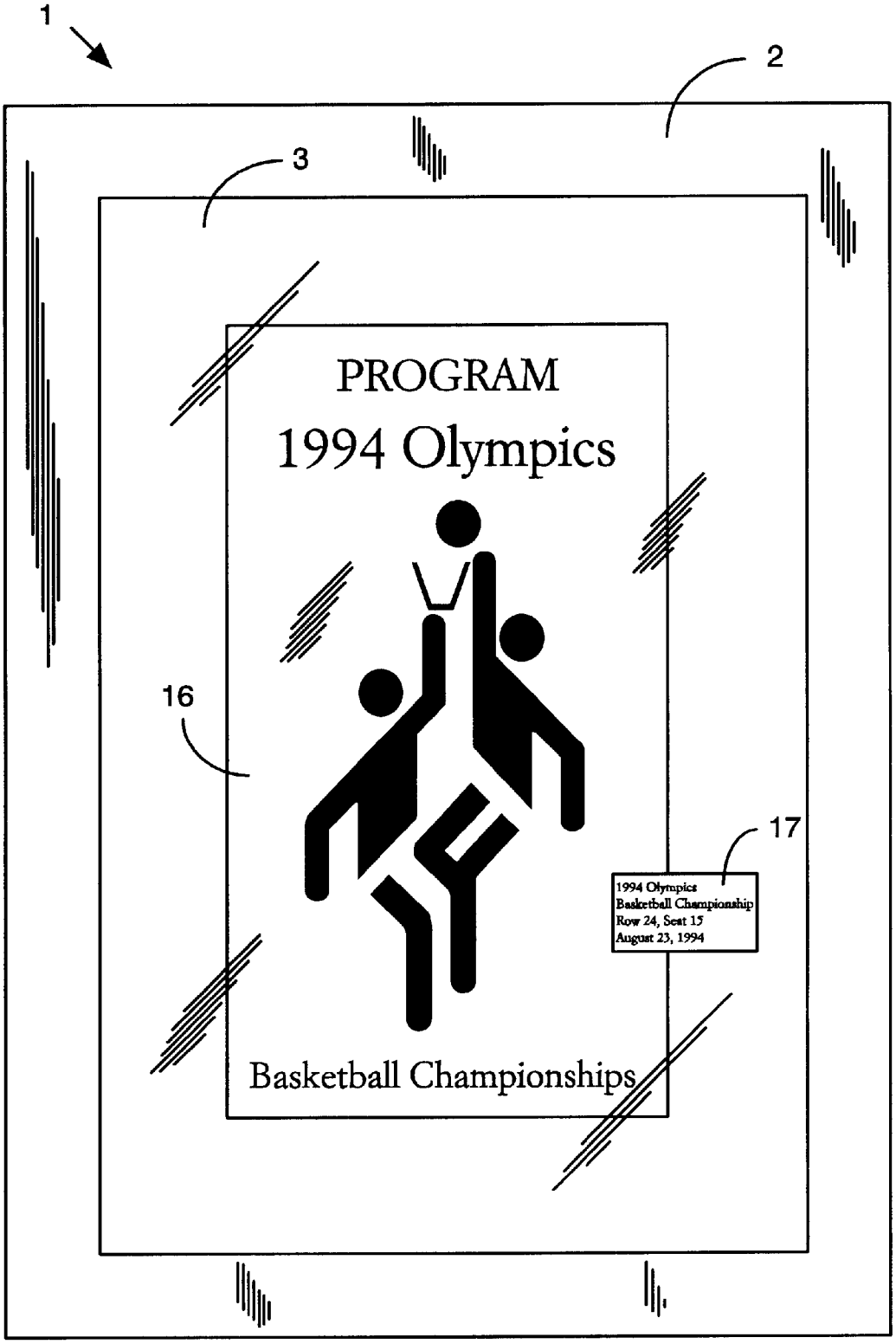
FIG. 7 is a front view of the preferred embodiment of FIG. 1 showing an event program installed in the frame. This figure also shows an admission ticket sandwiched between the matting and the transparent front panel of the frame.

FIG. 7 illustrates a front view of the frame 1 with an event program 16 installed. Also shown in this view is an admission ticket 17 to the event associated with the event program 16. In this figure, the admission ticket is sandwiched between the front panel 4 (shown in FIG. 1) and the matting 3 and secured by pressure. As used herein, the term "ticket" or "admission ticket" can include not only tickets which are actually used for admission to events, but also include any flat descriptive paper, receipt, claim stub, etc, or even a mere label that describes the contents of the frame 1.

Figure 8:
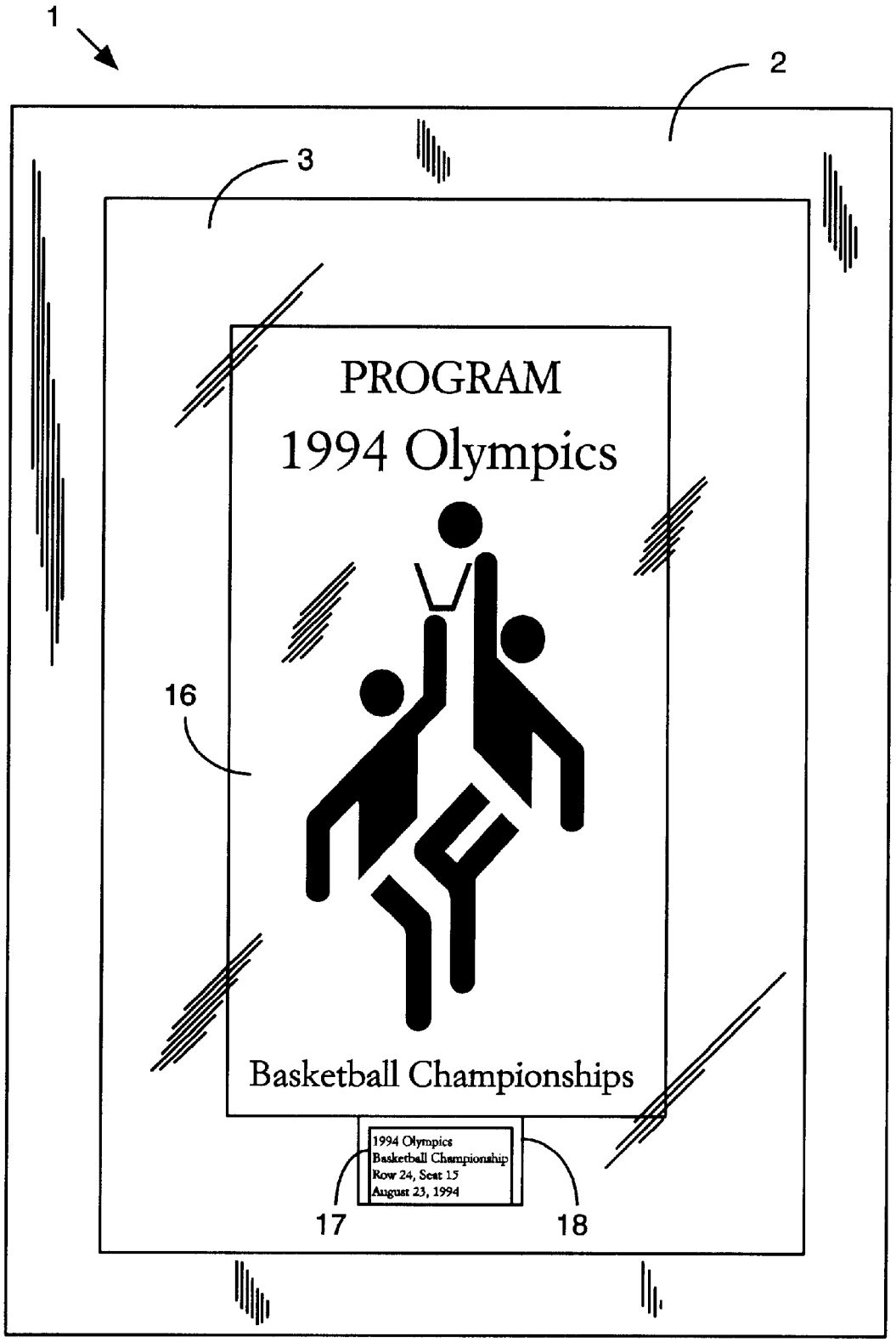
FIG. 8 is a front view of an alternative preferred embodiment which shows an event program installed in the frame. This figure also shows an admission ticket held in a pocket that is sized to hold the admission ticket from the event.

FIG. 8 illustrates a front view of an alternative preferred embodiment of the frame 1 with an event program 16 installed. In this alternative preferred embodiment, an integral slot 18 is provided to hold the admission ticket 17. While a separate compartment can be fabricated to form integral slot 18, the preferred embodiment envisions that integral slot 18 is formed as an indentation in the matting 3. This method achieves the desired result with no additional components and a desirable simplicity of design. Likewise, those skilled in the art will recognize that the admission ticket 17 can easily be replaced with a label used to identify the event. For the purposes of discussion, the term ticket will be used to describe either an admission ticket, a label, or any other identifying tag.

Figure 9:
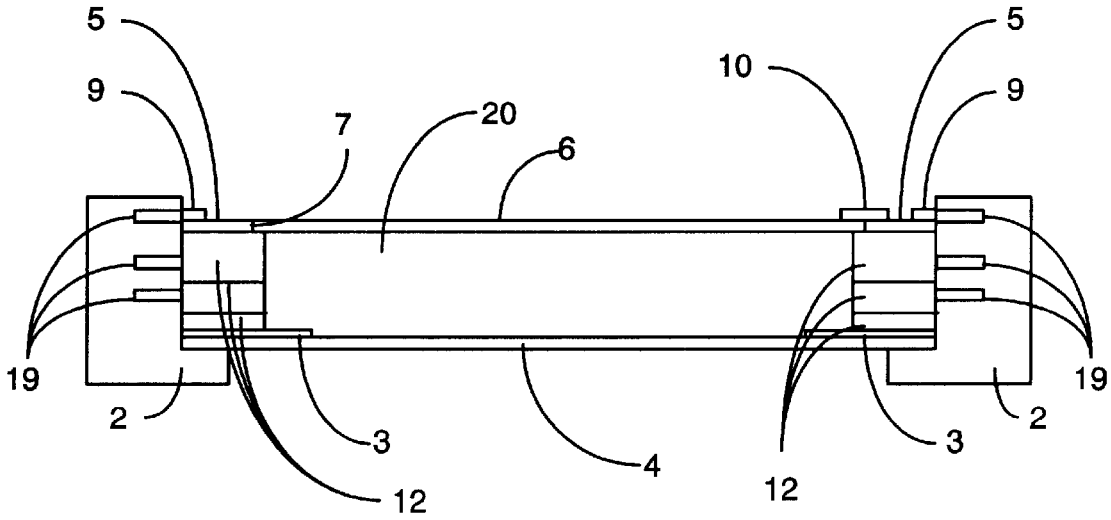
FIG. 9 is a cutaway end view of an alternative preferred embodiment which attaches the rear panel to one of multiple locations to adjust cavity depths.

FIG. 9 is a cut away end view of another alternative preferred embodiment. In this embodiment, the internal cavity 20 may have a depth that would vary in thickness to accommodate different objects. For illustrative purposes, the interior walls 12 are illustrated as having pin slots 19 a range such that the internal cavity 20 can be adjusted to a different depth depending on where the retaining pins 9 are inserted. The depth of the internal cavity 20 would be altered by moving the rear panel 5 toward or away from the front panel 4 to accommodate objects of varying thickness. The retaining pins 9 can be inserted into the peripheral borders 2 at any suitable location to accommodate an object of a given thickness. The retaining pins 9 are inserted into the peripheral borders 2 at locations which would set the depth of the internal cavity 20 between the front panel 4 and the rear panel 5 such that the object is secured between the front panel 4 and the rear panel 5. Of course, those skilled in the art will recognize that the retaining pins 9 can be, and typically would be, inserted directly into peripheral borders 2 without a pre-formed pin slot 19.

Figure 10:
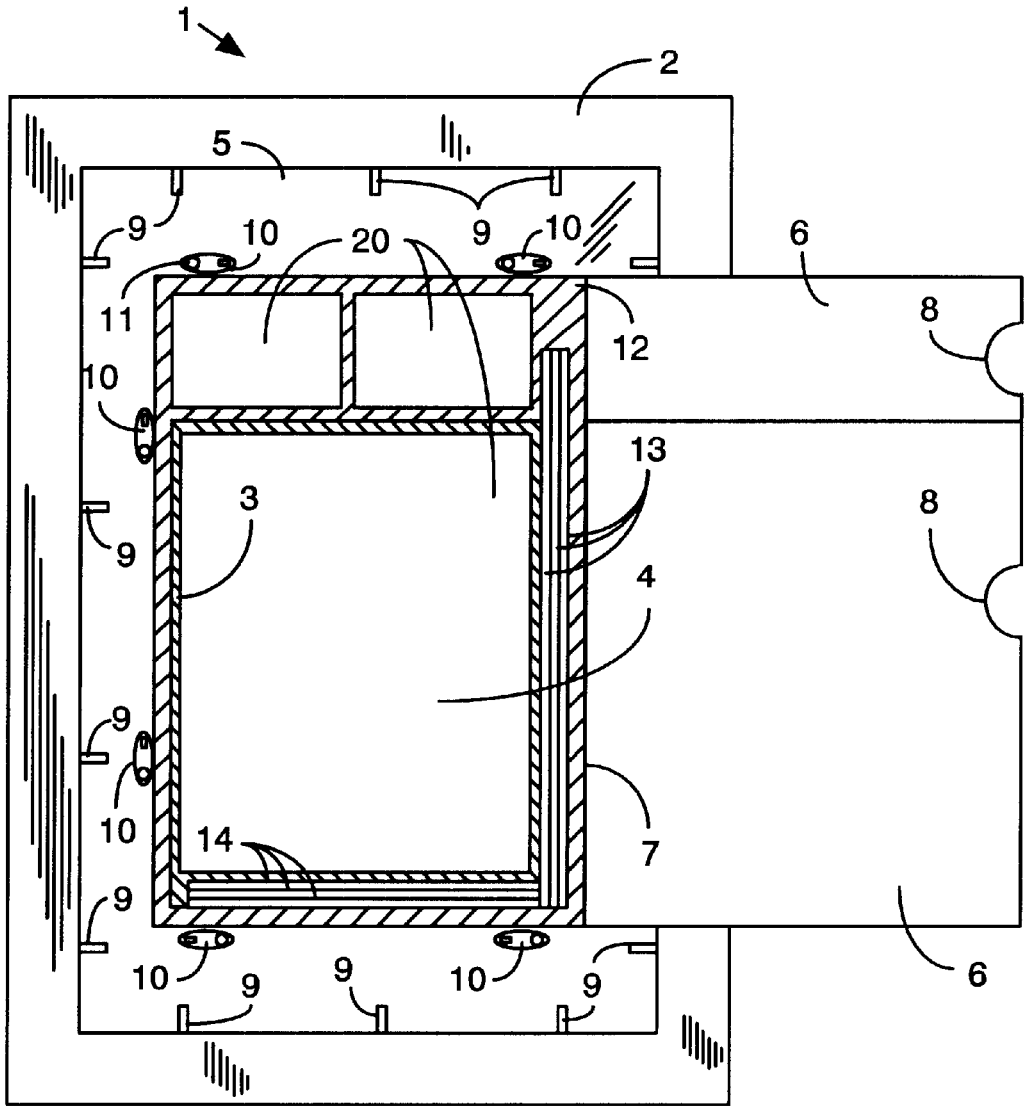
FIG. 10 is an alternative preferred embodiment which has small internal cavities which may contain items having different depths each having individually adjustable depths.

The FIG. 10, an alternative preferred embodiment is shown which provides multiple internal cavities 20 which form independent chambers for holding items such as event programs 16 and two-dimensional or three-dimensional nostalgic or related items. In this figure, the interior walls 12 defined three separate independent chambers 20. By fabricating the frame 1 in this manner, a relatively thin item such as an event program 16 can be placed in one chamber such that it is pressed against the front panel 4 for the best possible display, while thicker items, such as a golf ball, an award medal, etc, can be held in a deeper cavity to accommodate its size. As a result, each item displayed by frame 1 can be shown in the best possible manner.

While this figure illustrates a single access door 6 which provides access to all of the internal cavities 20 simultaneously, those skilled in the art will recognize that each internal cavity 20 can be provided with its own individual access door 6, and its own set of shims. As a result, each separate internal cavity 20 can be set to a different depth to accommodate a different item. For example, the depth of one internal cavity 20 can be adjusted to accommodate a publication describing a golf tournament, while a second internal cavity 20 can have its depth adjusted to accommodate a souvenir golf ball.

As can be seen from the foregoing preferred embodiments, frame 1 allows event programs 16 to be stored in a fully enclosed cavity within the frame 1. This allows the entire event program 16 to be stored without damaging it. More important, the access door 6 allows the event program 16 to be easily taken out to be examined, autographed, or read and then conveniently and easily placed back within the frame 1. Another important advantage of the invention is that due to the three-dimensional shimming system used within the frame 1, the same frame 1 can be used to accommodate publications such as event programs 16 having a variety of dimensions as well as other nostalgic items related to an event or the event program 16. The invention also provides a way of simultaneously displaying items of varying thicknesses within independent chambers that can each have the varying depths depending on the number of shims used.

Another advantage provided by the invention is that while it is designed to allow the display of one or more two and/or three-dimensional objects, it can also be used to display a single flat object in much the same manner as a conventional picture frame.

In addition, this invention allows an individual who may not be able to afford to have a custom frame fabricated by a professional framing company to create an attractive storage and display mechanism which can hold one or more three-dimensional objects simultaneously in one or more individually adjustable interior cavities. The frame 1 is designed to provide a low-cost, do-it-yourself display which can be easily arranged by the user to display a variety of three-dimensional objects. Heretofore, such displays required professionally done, expensive, custom-made frames. The frame includes a three-dimensional shimming system that provides separate horizontal vertical and depth shims to position objects within the frame. In addition to the foregoing advantages, the invention also provides a feature not found in custom-made frames. Namely, one or more rear access panels which allow objects within the frame to be easily and independently removed from the frame, and easily reinstalled in the frame at the user's convenience.

While the invention has been described with respect to a preferred embodiment thereof, it will be understood by those skilled in the art that various changes in detail may be made therein without departing from the spirit, scope, and teaching of the invention. For example, the materials used to fabricate the various components of the frame can be any materials which are suitable for the purpose. The shape of the frame can vary and does not have to be the conventional rectangular shape illustrated in the figures. Multiple independent cavities can also be used to accommodate three-dimensional objects of varying sizes. Accordingly, the invention herein disclosed is to be limited only as specified in the following claims.

I claim:

1. A framing system for displaying two and three-dimensional objects, further comprising:

a front panel;

a peripheral border having means to accept a front panel such that the perimeter of the front panel is in contact with the peripheral border;

a rear panel;

means to secure the rear panel to the peripheral border;

an interior wall sized to fit within the peripheral border, and between the rear panel and the front panel such that an internal cavity is formed;

an access door attached to the rear panel, the access door capable of being opened while the rear panel is secured to the peripheral border such that any objects stored within the internal cavity can be temporarily removed and replaced without removing the rear panel from the peripheral border;

vertical shims to vertically adjust the position of an object within the internal cavity; and horizontal shims to horizontally adjust the position of an object within the internal cavity;

whereby two-dimensional or a three-dimensional objects can be displayed in the internal cavity, and those objects can be temporarily removed from the frame and then returned to the frame via the rear access door, and whereby the position of objects within the internal cavity can be adjusted by selecting the appropriate amount of vertical or horizontal shims.

2. A framing system, as in claim 1, further comprising:

thickness shims for placement behind an object within the internal cavity such that the object is held in place adjacent to the front panel;

whereby the position of objects stored within the internal cavity can be controlled by selecting the appropriate amount of thickness shims.

3. A framing system, as in claim 2, wherein:

the interior wall defines two or more separate interior cavities;

whereby multiple objects can be stored in predefined locations within the frame.

4. A framing system, as in claim 3, wherein:

each internal cavity has an access door;

whereby the contents of each internal cavity can be independently accessed.

5. A framing system, as in claim 4, further comprising:

means to display a ticket separate from an object in the internal cavity of the frame.

6. A framing system, as in claim 1, wherein:

the interior wall defines two or more separate interior cavities;

whereby multiple objects can be stored in predefined locations within the frame.

7. A framing system, as in claim 6, wherein:

each internal cavity has an access door;

whereby the contents of each internal cavity can be independently accessed.

8. A framing system, as in claim 7, further comprising:

thickness shims for placement behind an object within the internal cavity such that the object is held in place adjacent to the front panel;

whereby the position of objects stored within the internal cavity can be controlled by selecting the appropriate amount of thickness shims.

9. A framing system, as in claim 6, further comprising:

means to display a ticket separate from an object in the internal cavity of the frame.

10. A framing system, as in claim 1, further comprising:

locking tabs arranged at predetermined locations on the rear panel, the locking tabs having an open position which does not interfere with movement of the access door, and a closed position which secures the access door in place;

whereby the access door can be opened to access objects within the internal cavity, and secured by the locking tabs as desired.

11. A framing system, as in claim 1, further comprising:

means to display a ticket separate from an object in the internal cavity of the frame.

12. A framing system, as in claim 11, further comprising:

a mat, the mat positioned inside the frame such that it is interposed between the front panel and the interior walls; and the mat further having an indented portion, the indented portion sized to accept a ticket;

whereby the indented portion provides the means to display the ticket.

* * * * *